US007695169B2

(12) United States Patent
Russello et al.

(10) Patent No.: US 7,695,169 B2
(45) Date of Patent: Apr. 13, 2010

(54) GASKET SYSTEM FOR A VANDAL RESISTANT LUMINAIRE

(75) Inventors: Thomas Russello, Freehold, NJ (US); Dylan A. Akinrele, Leonia, NJ (US); David S. Monteiro, Belleville, NJ (US); Kenneth W. Biello, Stroudsbourg, PA (US)

(73) Assignee: Genlyte Thomas Group LLC, Burlington, MA (US)

( * ) Notice: Subject to any disclaimer, the term of this patent is extended or adjusted under 35 U.S.C. 154(b) by 255 days.

(21) Appl. No.: 11/741,302

(22) Filed: Apr. 27, 2007

(65) Prior Publication Data

US 2007/0253200 A1 Nov. 1, 2007

Related U.S. Application Data

(60) Provisional application No. 60/745,915, filed on Apr. 28, 2006.

(51) Int. Cl.
*F21V 15/04* (2006.01)

(52) U.S. Cl. ..... 362/369; 362/390

(58) Field of Classification Search ..... 362/369, 362/362, 390, 158, 645, 267
See application file for complete search history.

(56) References Cited

U.S. PATENT DOCUMENTS

| | | | | |
|---|---|---|---|---|
| 1,215,894 | A | | 2/1917 | Yuyama |
| D51,774 | S | | 2/1918 | Coppinger |
| 1,356,145 | A | | 10/1920 | Hawthorne |
| 1,486,745 | A | | 3/1924 | Heselton |
| 1,545,711 | A | | 7/1925 | Townsend |
| 1,639,753 | A | | 8/1927 | Shelton |
| 2,075,199 | A | | 3/1937 | Horner |
| D104,401 | S | | 5/1937 | Kanter |
| 2,132,784 | A | | 10/1938 | Guth |
| D114,805 | S | | 5/1939 | Brooks |
| D115,417 | S | | 6/1939 | McCann |
| D137,508 | S | | 3/1944 | Asay |
| 2,632,095 | A | | 3/1953 | Dove |
| D172,522 | S | | 6/1954 | Stone |
| 2,732,484 | A | | 1/1956 | Lipscomb |
| D178,282 | S | | 7/1956 | Runtz |
| 2,767,305 | A | | 10/1956 | Onksen et al. |
| 2,853,599 | A | | 9/1958 | Kliegl |
| 2,979,603 | A | * | 4/1961 | Falge ..... 362/368 |
| D190,385 | S | | 5/1961 | Schreckengost |
| 3,065,340 | A | * | 11/1962 | Mead et al. ..... 362/369 |
| D199,142 | S | | 9/1964 | Daum |
| D199,144 | S | | 9/1964 | Daum |
| D202,212 | S | | 9/1965 | Izzi |
| D217,638 | S | | 5/1970 | Magi |
| D222,103 | S | | 9/1971 | Anderson |
| 3,610,915 | A | | 10/1971 | Moore |
| 3,666,935 | A | | 5/1972 | Pritchett et al. |
| 3,711,702 | A | | 1/1973 | Adra |

(Continued)

*Primary Examiner*—Bao Q Truong
(74) *Attorney, Agent, or Firm*—Middleton Reutlinger; John F. Salazar

(57) ABSTRACT

A gasket for a vandal resistant luminaire, the gasket is constructed to be disposed between an electrical component housing and a lens wherein the lens is held to the electrical component housing with a front trim ring surrounding an outer portion thereof. The gasket is designed to form a seal between the lens and electrical component housing and absorb physical shock placed on the lens and/or the electrical component housing.

20 Claims, 6 Drawing Sheets

U.S. PATENT DOCUMENTS 3,755,665 A 8/1973 Grindle
D229,713 S 12/1973 Wince et al.
D231,406 S 4/1974 Biallo
3,840,735 A 10/1974 Chan
3,895,227 A 7/1975 Murray et al.
3,919,542 A 11/1975 Castic
4,164,784 A 8/1979 Jaksich
4,288,846 A 9/1981 Fletcher et al.
D262,914 S 2/1982 Kristofek
4,323,953 A 4/1982 Hutchison
D267,516 S 1/1983 Rambusch et al.
D272,193 S 1/1984 Sangiamo
4,434,455 A 2/1984 Merritt
4,447,863 A 5/1984 Fenne
4,519,018 A 5/1985 Rowland
4,602,320 A 7/1986 Tomkin et al.
D286,206 S 10/1986 Joosten et al.
D286,446 S 10/1986 Caroli et al.
4,695,930 A 9/1987 Wierzbicki et al.
4,709,312 A 11/1987 Heinisch et al.
D294,066 S 2/1988 Ewing et al.
4,760,499 A 7/1988 Il
4,816,969 A 3/1989 Miller
D301,175 S 5/1989 Benjamin
D302,326 S 7/1989 DiCola
D302,327 S 7/1989 DiCola
D302,328 S 7/1989 Fretz
D302,329 S 7/1989 Fretz et al.
D302,330 S 7/1989 Fretz
4,858,091 A 8/1989 Fouke
D305,694 S 1/1990 Brown
D309,956 S 8/1990 Sikora et al.
D315,612 S 3/1991 Hughes et al.
D316,457 S 4/1991 De'Armond
5,020,277 A * 6/1991 Hellriegel ..... 49/400
D321,408 S 11/1991 Hughes et al.
D323,897 S 2/1992 Compton
5,086,379 A 2/1992 Denison et al.
5,158,348 A 10/1992 Sakamoto et al.
5,161,881 A 11/1992 Myson
5,174,648 A 12/1992 Clary et al.
D336,536 S 6/1993 Shaanan et al.
D336,964 S 6/1993 Janssen et al.
D337,835 S 7/1993 Donato et al.
D338,980 S 8/1993 Dieperink
D343,245 S 1/1994 Fouke et al.
D343,250 S 1/1994 Fouke et al.
D343,251 S 1/1994 Fouke et al.
5,278,737 A 1/1994 Luce et al.
D344,606 S 2/1994 Fouke et al.
D345,432 S 3/1994 Gruber et al.
D345,433 S 3/1994 Gruber et al.
D345,434 S 3/1994 Gruber et al.
D346,874 S 5/1994 Fiorato
D347,292 S 5/1994 Roos et al.
D347,486 S 5/1994 Gruber et al.
D348,531 S 7/1994 Mehaffey et al.
D352,124 S 11/1994 Russello et al.
5,377,087 A 12/1994 Yoon
D354,580 S 1/1995 Fouke et al.
D355,044 S 1/1995 Russello et al.
D357,761 S 4/1995 Dewinter
5,404,297 A 4/1995 Birk et al.
D358,898 S 5/1995 Compton
D358,902 S 5/1995 Webster, III
5,416,684 A 5/1995 Pearce
D364,242 S 11/1995 Fiorato
D370,228 S 5/1996 Chapman et al.
5,562,481 A 10/1996 Myson
5,584,574 A 12/1996 Haddad
D377,990 S 2/1997 Nakano
5,642,934 A 7/1997 Haddad
5,666,021 A 9/1997 Myson
D385,643 S 10/1997 Brohard et al.
D390,999 S 2/1998 Gaskins et al.
D391,659 S 3/1998 Gaskins et al.
D393,733 S 4/1998 Gaskins et al.
D399,331 S 10/1998 Greene et al.
D399,332 S 10/1998 Greene et al.
D399,333 S 10/1998 Greene et al.
D400,286 S 10/1998 Greene et al.
5,902,035 A 5/1999 Mui
D415,304 S 10/1999 Brown
5,971,571 A 10/1999 Rose
D418,626 S 1/2000 Herst et al.
6,042,251 A 3/2000 McCarthy et al.
D424,736 S 5/2000 Johnson
D429,362 S 8/2000 Landefeld
D437,958 S 2/2001 Doron, Jr. et al.
D440,692 S 4/2001 Janos et al.
D442,313 S 5/2001 Wojtkowiak et al.
D444,258 S 6/2001 Bradford et al.
D445,943 S 7/2001 Littman
D446,340 S 8/2001 Bradford et al.
D447,590 S 9/2001 Raouf et al.
6,338,565 B1 1/2002 Fager et al.
6,352,358 B1 3/2002 Lieberman et al.
D456,551 S 4/2002 Russello et al.
D456,552 S 4/2002 Russello et al.
D456,553 S 4/2002 Russello et al.
D456,926 S 5/2002 Gaskins et al.
D456,927 S 5/2002 Russello et al.
D456,928 S 5/2002 Russello et al.
D456,929 S 5/2002 Russello et al.
D456,930 S 5/2002 Russello et al.
D459,515 S 6/2002 Gaskins et al.
D459,519 S 6/2002 Russello et al.
D460,575 S 7/2002 Tergny et al.
6,422,709 B1 7/2002 Panagiotou
D465,048 S 10/2002 Gaskins et al.
D465,868 S 11/2002 Gaskins et al.
6,474,846 B1 11/2002 Kelmelis et al.
D467,030 S 12/2002 Gaskins et al.
D468,051 S 12/2002 Gaskins et al.
D469,565 S 1/2003 Anderson et al.
D472,339 S 3/2003 Russello et al.
6,558,033 B1 * 5/2003 Ruuttu et al. ..... 362/523
D482,487 S 11/2003 Russello et al.
D494,701 S 8/2004 Campbell

* cited by examiner

GASKET SYSTEM FOR A VANDAL RESISTANT LUMINAIRE

STATEMENT REGARDING FEDERALLY SPONSORED RESEARCH OR DEVELOPMENT

Not applicable.

FIELD OF INVENTION

The present invention relates to luminaires or more specifically a sealing and physical shock absorbing gasket for a vandal-resistant luminarie.

BACKGROUND OF THE INVENTION

Many existing public locations, both indoor and outdoor, have luminaires installed. Even though these luminaires are intended to benefit the public they are often times an annoyance for a would be vandal or thief. Therefore, luminaires have long have been targeted for disablement or destruction by vandals, thieves, and others seeking to reduce the amount of light present in a given locale. Luminaire electrical component housings and lamps contained within the electrical component housings of such luminaires are typically fragile in construction. Physical impact or even mere jarring can disable a luminaire or even destroy a portion thereof. The damage can occur to the electrical component housing, lamp, lens, or other component thereby extinguishing the light emitted by the luminaire. Attempts have been made to address this problem for those seeking to maintain the functional status of a luminaire in a public place. This has been addressed by constructing armored luminaires which have an armored electrical component housing or by placing the luminaire out of reach to the public. However, the armor has tended to make the luminaire less aesthetic than desired and the locating of the luminaires out of reach often times decreases the ability of the luminaire to light a desired area. The armor and location of the luminaires has also tended to increase maintenance costs associated with keeping the luminaires operational. More recently, vandal resistant luminaires have been constructed of plastics. However, these luminaires have lacked the capability to resist tampering and to provide an aesthetic luminaire as is desired.

Thus a need continues to exist for luminaires to resist the attempts of vandals, would-be thieves, and the like from destroying the luminaire or extinguishing the light emitted thereby while providing adequate light, protection from environmental elements, and a means for maintaining the luminaire without excessive maintenance costs.

SUMMARY OF THE INVENTION

The present invention relates to a gasket for use in a vandal resistant luminaire intended for use in a public area and designed to resist physical damage from impact while providing adequate light, an aesthetic luminaire, and an economic means for maintenance. The luminaire gasket is designed to absorb physical shock placed on the luminaire lens, seal the lens with the electrical component housing and protect the lamp and other internal components from environmental elements.

Preferably the gasket is comprised of extra thick extruded silicon rubber and has a cross-sectional configuration that absorbs physical shock from lens impact while sealing against dust, moisture, and water. The cross-sectional configuration is such that when in a sealing configuration it is expanded providing a seal and when a shock is placed about the lens the gasket compresses wherein it absorbs the shock improving the luminaires resistance to tampering.

DETAILED DESCRIPTION

The present invention relates to a gasket for use in a vandal resistant luminaire intended for use in a public area and designed to resist physical damage from impact while providing adequate light, an aesthetic luminaire, and an economic means for maintenance. The luminaire gaskets depicted in the various figures are selected solely for the purpose of illustrating the invention. Other and different gaskets may utilize the inventive features described herein. Reference to the Figures showing embodiments are made only for descriptive purposes and are not intended to limit the scope of the claims and disclosure herein.

Figure 1:
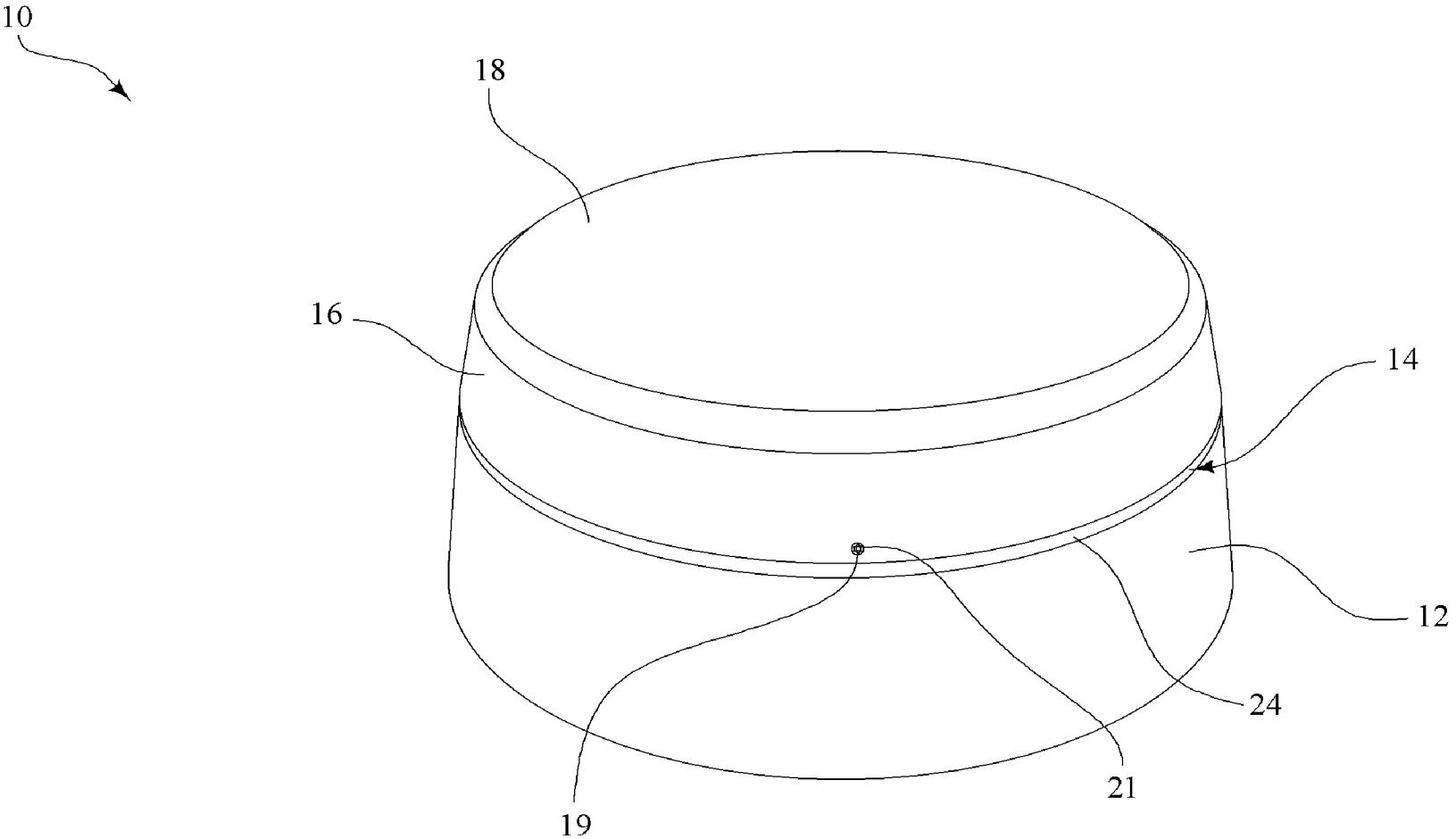
FIG. 1 is a perspective view of a vandal resistant luminaire showing external components thereof.

FIG. 1 shows the external components of vandal resistant luminaire 10. Rear trim ring 12 covers electrical component housing 14 providing an aesthetically pleasing rear side of luminaire 10 while increasing security of luminaire 10 by providing a smooth outer side surface mounting flush against a wall or ceiling reducing pry and hold points. Electrical component housing 14 has an outer lip 24 visible in fully assembled luminaire 10 between rear trim ring 12 and front trim ring 16. Front trim ring 16 locks onto electrical component housing 14 and is held in a locked position with locking fastener 19 extending through locking fastener receptacle 21 in front trim ring 16. Front trim ring 16 holds lens 18 to electrical component housing 14 providing a smooth outer surface for vandal resistant luminaire 10.

Figure 2:
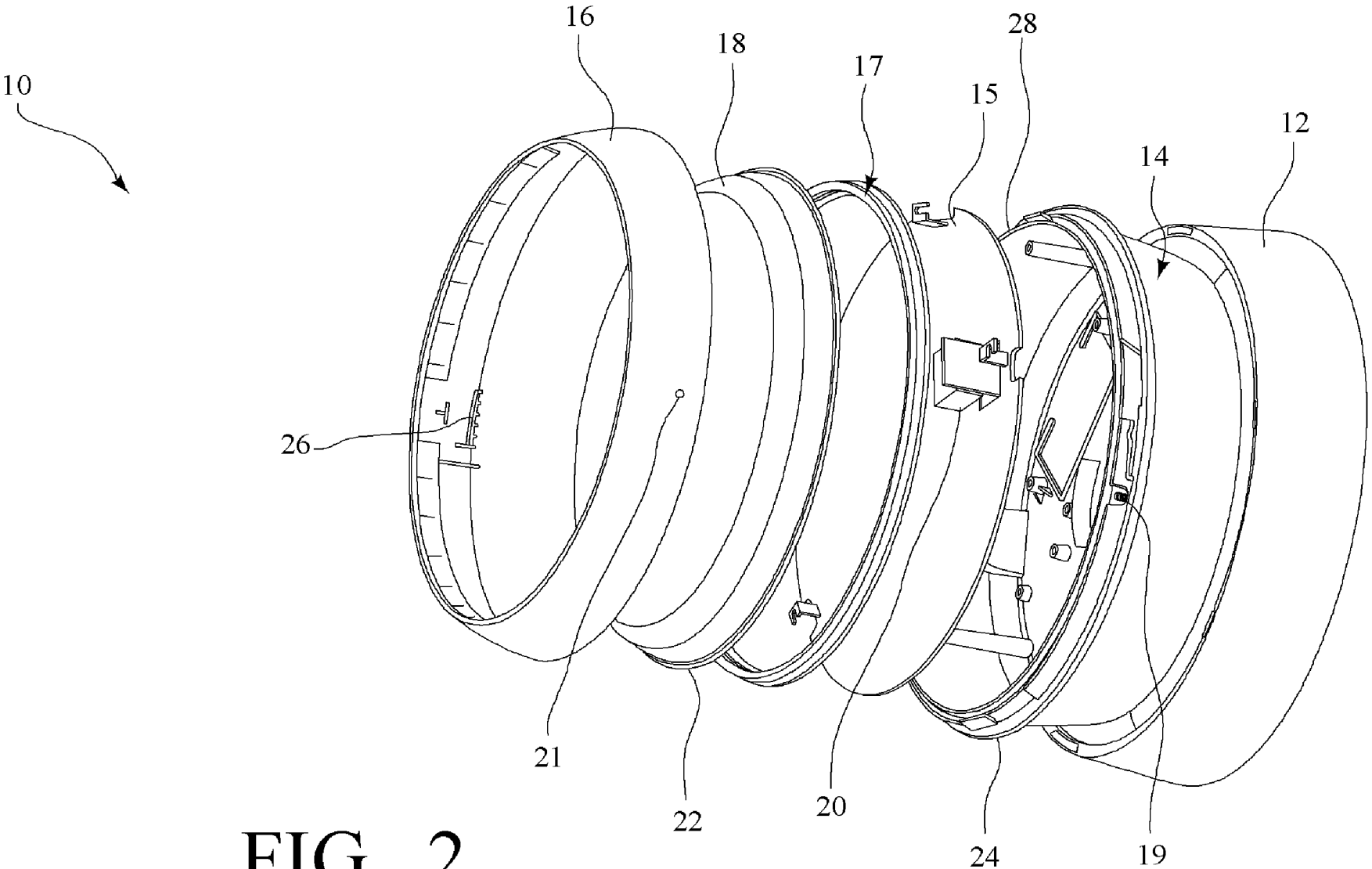
FIG. 2 is an exploded view of a vandal resistant luminaire showing the placement of a gasket therein.

FIG. 2 shows the internal components of vandal resistant luminaire 10 and the placement of gasket 17 therein. Rear trim ring 12 is removed from electrical component housing 14 showing the outer configuration of electrical component housing 14 and cooperation between rear trim ring 12 and outer lip 24 of electrical component housing 14. Lamp holder assembly 15 attaches within electrical component housing 14 and has lamp socket 20 on a front surface. The front surface of lamp holder 15 is preferably comprised of a reflective material. Front trim ring 16 holds lens 18 to electrical component housing 14 with gasket 17 there between providing a smooth outer surface for vandal resistant luminaire 10. Gasket 17 is placed about gasket ring 28, both of which are shown having a continuously round configuration, on electrical component housing 14. Front trim ring 16 has locking lugs 26 for securing about electrical component housing 14 and locked thereto with locking fastener 19 depending into locking fastener receptacle 21 in front trim ring 16. Lens 18 has outer lip 22 that cooperates with front trim ring 16 on an outer surface and gasket 17 in an inner surface.

Figure 3:
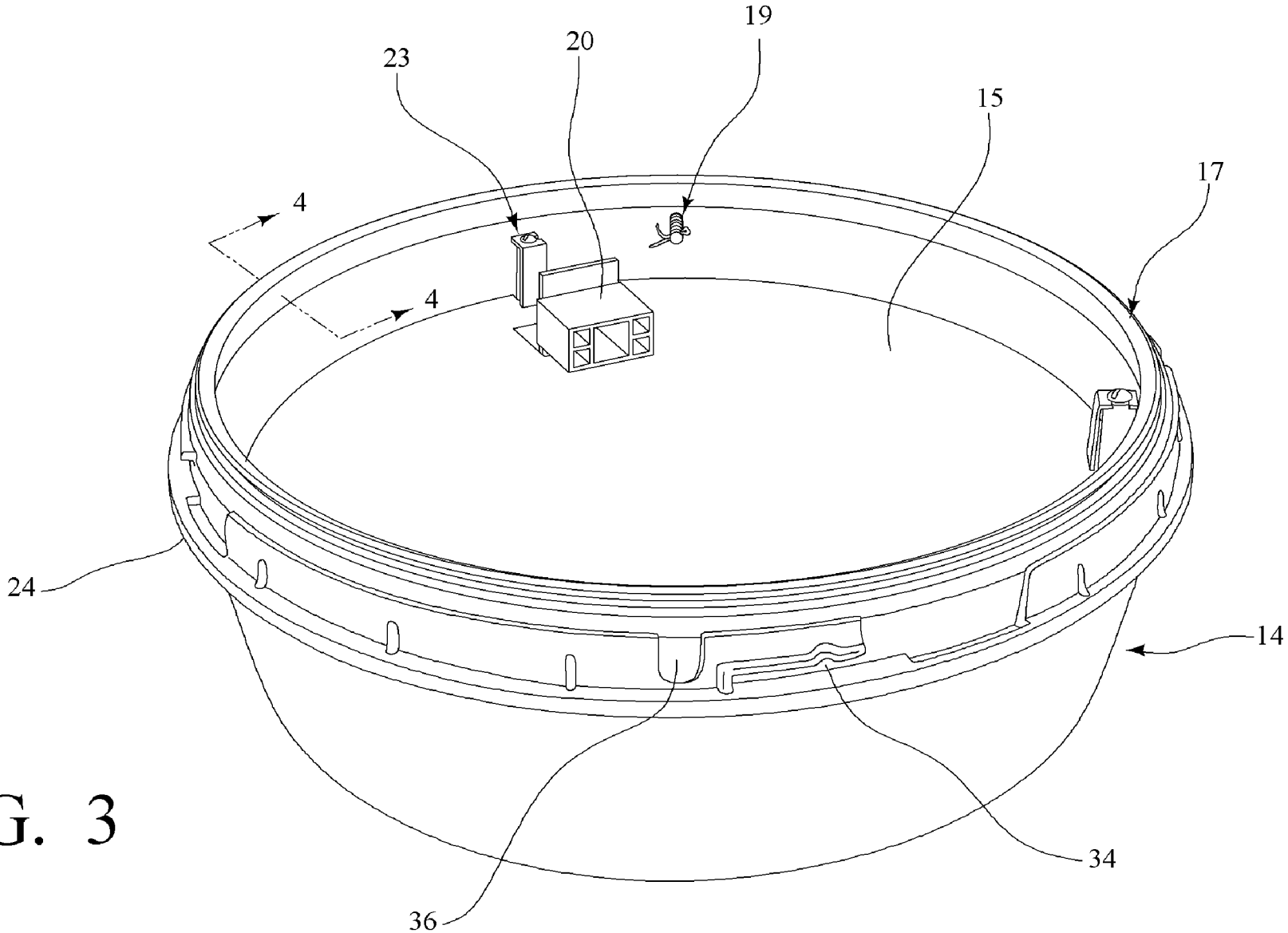
FIG. 3 is a perspective view of a electrical component housing for a vandal resistant luminaire having a gasket placed about a front rim.

FIG. 3 shows electrical component housing 14 having gasket 17 attached to gasket ring 28. Within electrical component housing 14 is lamp holder assembly 15 having lamp socket 20. Preferably, the outer surface of lamp holder assembly 15 is comprised of a reflective material and is attached to electrical component housing 14 with bracket and fastener combinations 23. The electrical wiring, ballast(s), if needed, and other associated electrical components of luminaire 10 are contained within electrical component housing 14 behind lamp holder assembly 15. On the outer rim of electrical component housing 14 above outer lip 24 are lug receptacles 34 for receiving locking lugs 26 on front trim ring 16. Locking fastener 19 is also in the outer rim of electrical component housing 14 within a notch 36 for locking front trim ring 16 onto electrical component housing 14.

Figure 5:
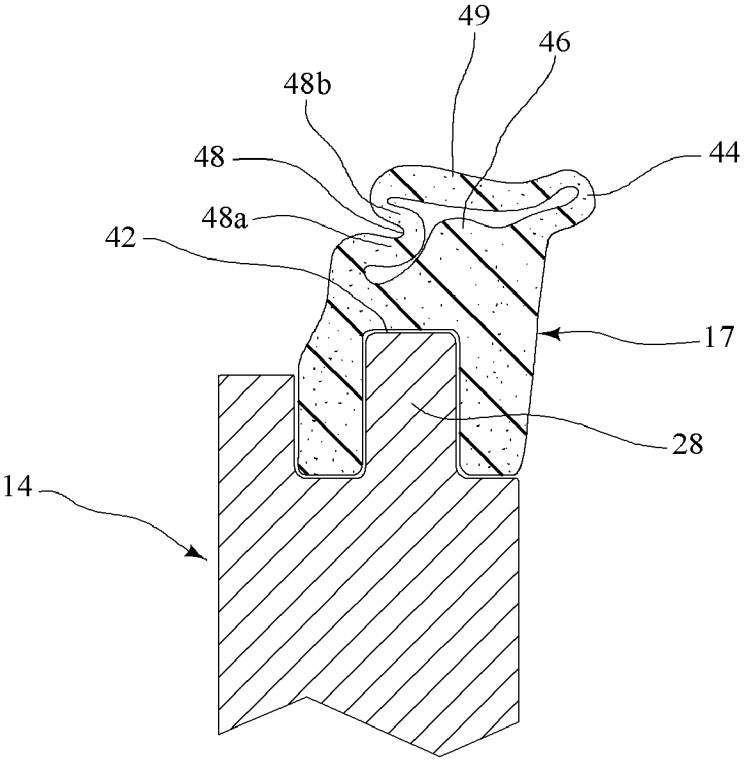
FIG. 5 is a cross-sectional view of the gasket of FIG. 4 in a compressed configuration.
Figure 4:
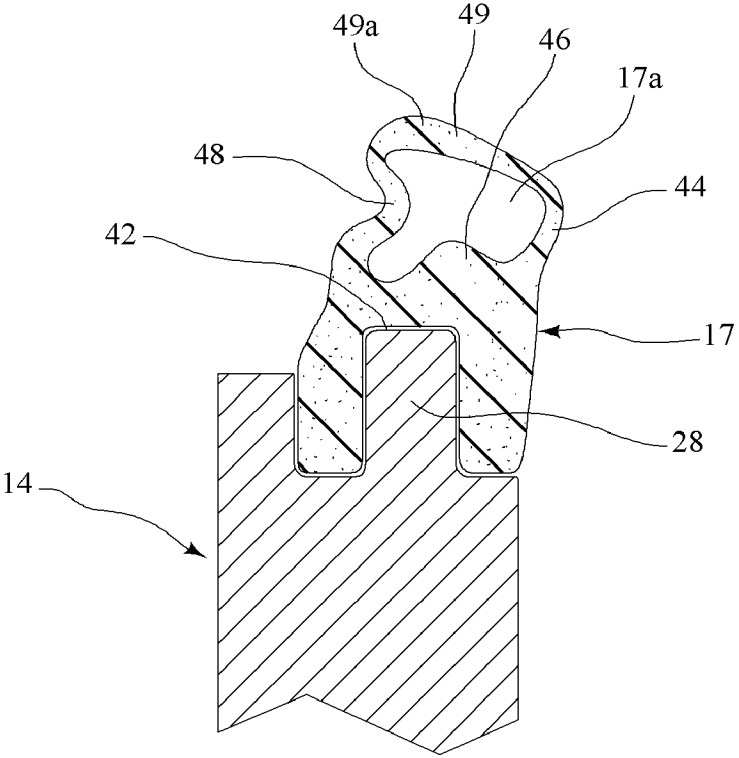
FIG. 4 is a cross-sectional view of an embodiment of a gasket for a vandal resistant luminaire in an expanded configuration.

FIG. 4 shows a cross-sectional view of a gasket 17 taken along 4-4 of FIG. 3 for vandal resistant luminaire 10 in an expanded configuration. Gasket 17 has hollow interior 17*a* and is placed on gasket ring 28 by having gasket ring receiving notch 42 receiving gasket ring 28. Lower wall 46 of gasket 17 has a raised portion for absorbing physical shock. Inner wall 44 is convex or depends slightly outward to top wall 49. Top wall 49 is shown as being angled upward toward outer wall 48 providing a sealing surface toward an outer portion of luminaire 10 for sealing with lens 18. Top wall 49 also has a thickened shock absorbing region 49*a*. Outer wall 48 is convex or depends inward so that when a force is placed on top wall 49 outer wall 48 folds inward providing shock absorbing material 48*a* and 48*b* between electrical component housing 14 and lens 18. FIG. 5 shows the gasket of FIG. 4 in a compressed configuration. In this configuration outer wall 48 is folded inward providing two additional layers of gasket material 48*a* and 48*b* between electrical component housing 14 and lens 18. This inward collapsing wall provides gasket 17 with additional shock absorbing capacity when a physical shock is placed on top wall 49.

Figure 6:
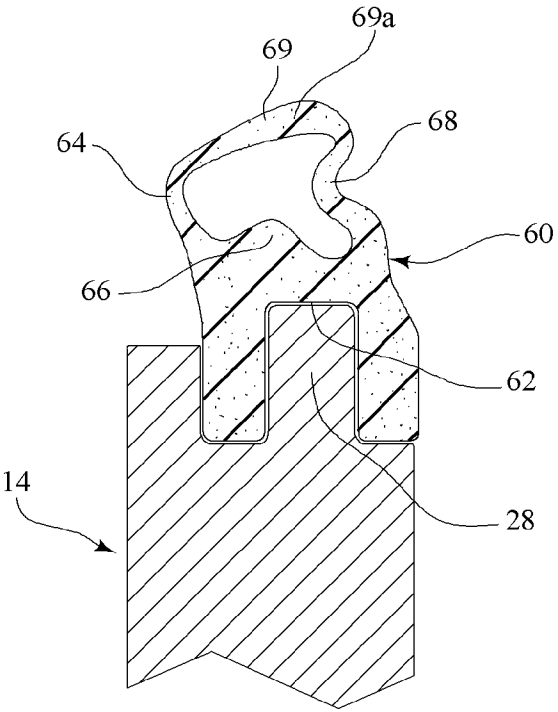
FIG. 6 is a cross-sectional view of an alternative embodiment of a gasket for a vandal resistant luminaire in an expanded configuration.

FIG. 6 shows gasket 60 for a vandal resistant luminaire 10 in an expanded configuration. Gasket 60 has a cross-sectional configuration being substantially a mirror image of gasket 17. Gasket 60 is placed on gasket ring 28 by having gasket ring receiving notch 62 receiving gasket ring 28. Lower wall 66 of gasket 60 has raised area for absorbing physical shock. Outer wall 64 is convex and depends slightly outward to top wall 69. Top wall 69 is shown as being angled upward toward inner wall 68 providing a sealing surface toward an inner portion for sealing with lens 18. Top wall 69 also has a thickened shock absorbing region 69*a*. Inner wall 68 is concave and depends inward so that when a force is placed on top wall 69 inner wall 68 folds inward providing shock absorbing material between electrical component housing 14 and lens 18.

Figure 8:
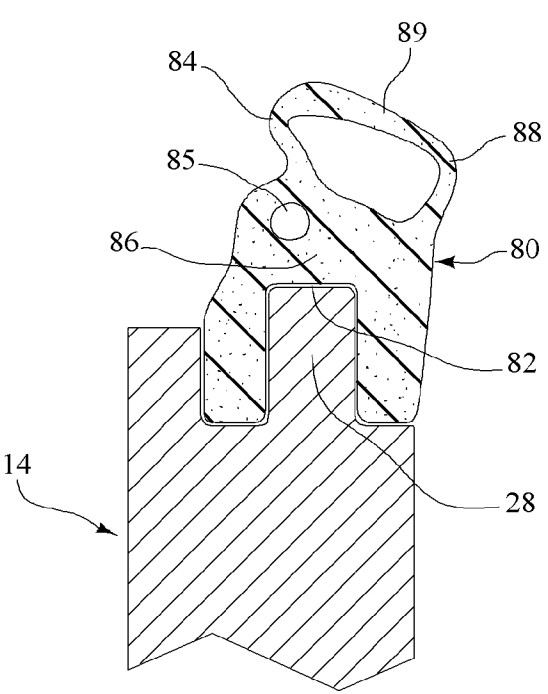
FIG. 8 is a cross-sectional view of yet another alternative embodiment of a gasket for a vandal resistant luminaire in an expanded configuration.
Figure 7:
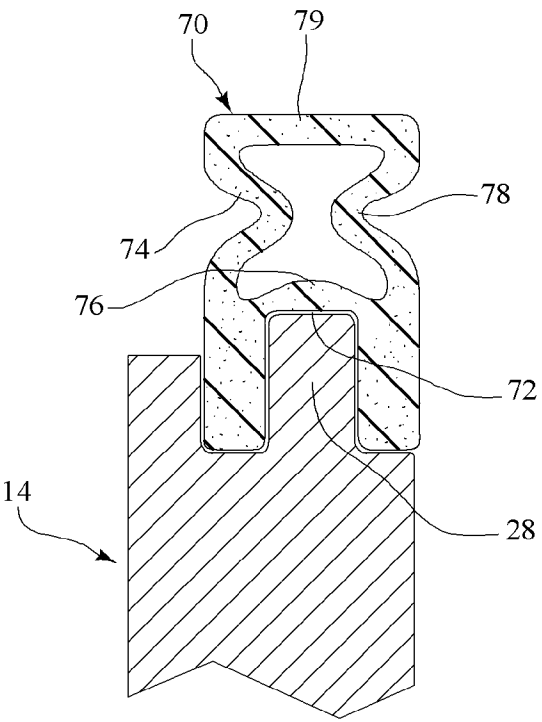
FIG. 7 is a cross-sectional view of another alternative embodiment of a gasket for a vandal resistant luminaire in an expanded configuration.

FIGS. 7 and 8 show cross-sectional views of alternative embodiments of a sealing shock absorbing gasket in an expanded configuration for vandal resistant luminaire 10. FIG. 7 shows gasket 70 placed on gasket ring 28 by having gasket ring receiving notch 72 receiving gasket ring 28. Lower wall 76 of gasket 70 has raised area for absorbing physical shock. Outer wall 74 and inner wall 78 are both concave and depend inward so that when a force is placed on top wall 79 both outer wall 74 and inner wall 78 fold inward providing shock absorbing material between electrical component housing 14 and lens 18. Top wall 79 is shown as being substantially flat providing a sealing surface for sealing with lens 18. Top wall 79 may optionally have a thickened shock absorbing region. Gasket 80, as shown in FIG. 8, is placed on gasket ring 28 by having gasket ring receiving notch 82 receiving gasket ring 28. Lower wall 86 of gasket 80 has raised area with a void space 85 for absorbing physical shock. Outer wall 84 depends slightly inward to top wall 89 and folds inward when gasket 80 is compressed with a force placed on top wall 89. Top wall 89 is shown as being angled upward toward outer wall 84 providing a sealing surface toward an outer portion for sealing with lens 18. Top wall 89 has a thickened shock absorbing region. Inner wall 88 is convex and depends outwardly.

Figure 9:
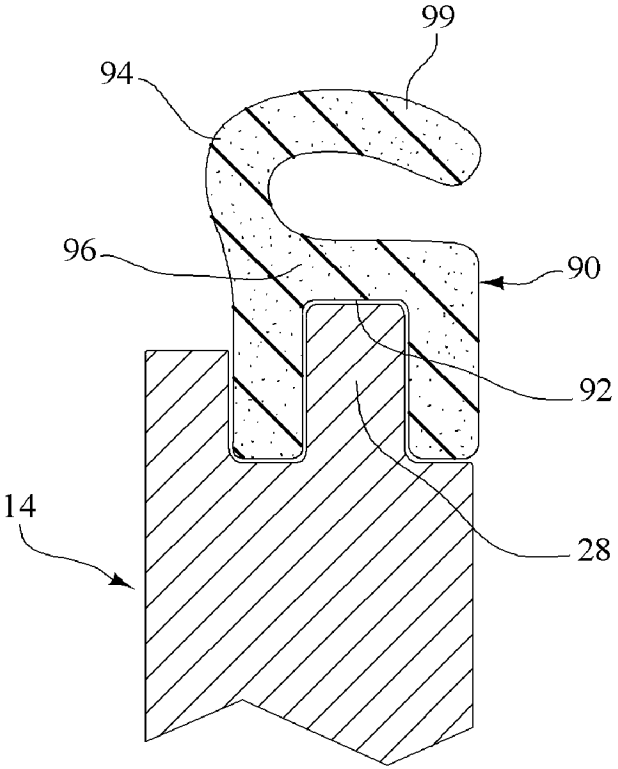
FIG. 9 is a cross-sectional view of an embodiment of a gasket for a vandal resistant luminaire having an open configuration.

FIG. 9 shows gasket 90 for a vandal resistant luminaire 10 in an expanded configuration. Gasket 90 has an open cross-sectional configuration. Gasket 90 is placed on gasket ring 28 of electrical component housing 14 by having gasket ring receiving notch 92 receiving gasket ring 28. Lower wall 96 of gasket 90 is substantially flat. Side wall 94 depends slightly outward to top wall 99. Top wall 99 is shown as being curved providing a sealing surface for sealing with lens 18.

Figure 10:
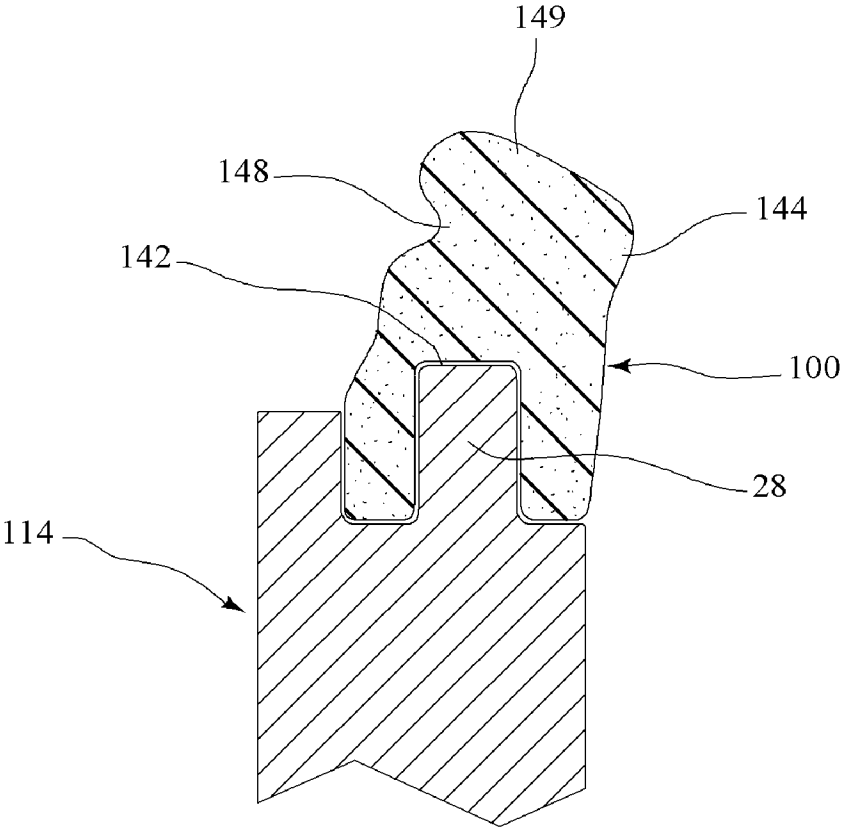
FIG. 10 is a cross-sectional view of an embodiment of a gasket for a vandal resistant luminaire having a solid configuration.

FIG. 10 shows a cross-sectional view of a gasket 100 for vandal resistant luminaire 10 in an expanded configuration. Gasket 100 is placed on gasket ring 28 by having gasket ring receiving notch 142 receiving gasket ring 28. Inner wall 144 depends slightly outward to top wall 149. Top wall 149 is shown as being angled upward toward outer wall 148 providing a sealing surface toward an outer portion of luminaire 10 for sealing with lens 18. Outer wall 148 depends inward so that when a force is placed on top wall 149 outer wall 148 folds inward. Inward collapsing wall 148 provides gasket 100 with additional shock absorbing capacity when a physical shock is placed on top wall 149.

Preferably the vandal resistant luminaire gasket is comprised of a silicon rubber material. However, other materials having flexing, shock absorbing and sealing properties may be used to construct the gasket. Preferably the gasket is extruded and may have a thickened or even solid cross-sectional configuration providing additional shock absorbing capacity. In an expanded configuration the gasket seals dust, moisture, and water in the environment from the internal components of the luminaire. The sealing shock absorbing gasket can have a multitude of configurations, several of which have been shown.

We claim:

1. A vandal resistant luminaire with a sealing and shock absorbing gasket, said gasket being comprised of a compressible material and disposed between an electrical component housing and a lens, in contact with said lens, said lens being held proximate said electrical component housing with a front trim ring surrounding an outer portion of said lens and said electrical component housing, said gasket having an expanded sealing configuration and a compressed shock absorbing configuration suitable for protecting said vandal resistant luminaire from environmental elements and physical shock placed on said lens, said physical shock absorbing configuration of said gasket providing a sufficient quantity of said compressible material between said lens and said housing to adequately absorb said shock to resist breakage of said lens;

wherein said gasket has an upper cross-sectional portion with a hollow core, said hollow core formed by a bottom wall, an inner wall, a top wall, and an outer wall of said gasket.

2. The vandal resistant luminaire of claim 1 wherein said gasket has a rounded configuration where it contacts said lens.

3. The vandal resistant luminaire of claim 1 wherein said gasket comprises a silicon rubber material.

4. The vandal resistant luminaire of claim 1 wherein said gasket is formed by an extrusion process.

5. The vandal resistant luminaire of claim 1 wherein said gasket has a bottom surface with a receiving notch therein suitable for receiving a front edge of said electrical component housing.

6. The vandal resistant luminaire of claim 1 wherein said gasket bottom wall has a raised thickened portion of said compressible material.

7. The vandal resistant luminaire of claim 1 wherein said gasket inner wall has a convex configuration suitable for folding inwardly when a force is placed on said top wall.

8. The vandal resistant luminaire of claim 1 wherein said gasket top wall has a thickened portion of said compressible material.

9. The vandal resistant luminaire of claim 1 wherein said gasket outer wall has a concave configuration suitable for folding inwardly when a force is placed on said top wall.

10. A vandal resistant luminaire having a gasket disposed between a lens and a housing, said gasket having an upper cross-sectional portion with a hollow core, said upper portion forming said hollow core with a top wall, inner wall, bottom wall, and outer wall, said bottom wall having a raised thickened portion, said inner wall having a convex configuration, said top wall having a thickened portion, and said outer wall having a concave configuration.

11. The vandal resistant luminaire of claim 10 wherein said gasket outer wall is structured to fold inwardly into a shock absorbing configuration when a force is placed on said top wall, said gasket in said shock absorbing configuration having said top wall, and inner wall adjacent said bottom wall forming four layers of shock absorbing material between said lens and said housing.

12. The vandal resistant luminaire of claim 10 wherein said gasket comprises a silicon rubber material.

13. The vandal resistant luminaire of claim 10 wherein said gasket is formed by an extrusion process.

14. The vandal resistant luminaire of claim 10 wherein said gasket has a bottom surface with a receiving notch therein suitable for receiving a front edge of said housing.

15. The vandal resistant luminaire of claim 10 wherein said gasket has a substantially rounded configuration adjacent said lens.

16. A circular gasket comprising a circular gasket with a receiving notch in a lower portion and a hollow core in an upper portion, said hollow core having an irregular cross-sectional configuration such that when a compression force is placed on said gasket opposite said receiving notch said hollow core collapses providing multiple layers of compressible material to absorb the physical shock delivered by said compression force.

17. The gasket of claim 16 wherein said hollow core in said gasket has at least one side wall collapsed inwardly when said compression force is placed on said gasket providing two additional shock absorbing layers of said material comprising said gasket between a top and bottom wall of said gasket.

18. The gasket of claim 16 wherein said gasket hollow core has a bottom wall with a raised portion of said material comprising said gasket.

19. The gasket of claim 16 wherein said gasket comprises an extruded silicon rubber material.

20. A vandal resistant luminaire with comprising a sealing and shock absorbing gasket, said gasket being disposed between an electrical component housing and a lens, said lens being held to said electrical component housing with a front trim ring surrounding an outer portion of said lens and said electrical component housing, said gasket made of a compressible material and having a shock absorbing hollow core suitable for protecting said vandal resistant luminaire from environmental elements and physical shock placed on said lens or said electrical component housing, said electrical component housing having wiring and at least one lamp socket contained therein;

said gasket having a hollow core with a top wall, inner wall, bottom wall and outer wall.

* * * * *